US005701938A

United States Patent [19]

Brand

[11] Patent Number: 5,701,938

[45] Date of Patent: Dec. 30, 1997

[54] METHOD AND APPARATUS FOR RETAINING A FLITCH FOR CUTTING

[75] Inventor: Robert D. Brand, Lawrence, Ind.

[73] Assignee: Capital Machine Company, Inc., Indianapolis, Ind.

[21] Appl. No.: 685,207

[22] Filed: Jul. 23, 1996

Related U.S. Application Data

[63] Continuation of Ser. No. 455,479, May 31, 1995, Pat. No. 5,562,137.

[51] Int. Cl.[6] ..... B27C 1/00; B27M 1/02

[52] U.S. Cl. ..... 144/363; 144/178; 144/209.1; 144/356; 269/50; 269/54.5; 269/265

[58] Field of Search ..... 144/177, 178, 144/209.1, 214, 215.3, 359, 363, 369, 356, 365; 269/47, 50, 52, 54.1, 52.2, 54.3, 265, 268

[56] References Cited

U.S. PATENT DOCUMENTS

| | | | |
|---|---|---|---|
| 793,306 | 6/1905 | Koss . | |
| 2,576,520 | 11/1951 | Koss | 144/178 |
| 2,676,627 | 4/1954 | McFall | 144/178 |
| 3,441,069 | 4/1969 | Koss | 144/309 |
| 3,654,973 | 4/1972 | Koss | 144/178 |
| 3,680,612 | 8/1972 | Hale | 144/178 |
| 3,808,925 | 5/1974 | Hards | 83/346 |
| 3,905,408 | 9/1975 | Hale | 144/178 |
| 4,068,693 | 1/1978 | Cremona | 144/178 |
| 4,069,850 | 1/1978 | Cremona | 144/178 |
| 4,392,519 | 7/1983 | Calvert | 144/212 |
| 4,503,896 | 3/1985 | Brand | 144/369 |
| 4,587,616 | 5/1986 | Weil | 364/475 |
| 4,601,317 | 7/1986 | Brand | 144/178 |
| 4,683,926 | 8/1987 | Weil | 144/178 |
| 5,101,874 | 4/1992 | Weil | 144/209 |
| 5,143,129 | 9/1992 | Toivio | 144/211 |
| 5,150,746 | 9/1992 | Weil | 144/209 |
| 5,333,658 | 8/1994 | Albion et al. | 144/213 |
| 5,385,184 | 1/1995 | Mellor | 144/178 |

FOREIGN PATENT DOCUMENTS

0627285 A2 7/1994 European Pat. Off. .

OTHER PUBLICATIONS

*Double Dogging Flitch System*, Sales Brochure of Capital Machine Co., Inc., Indianapolis, Indiana.

*Primary Examiner*—W. Donald Bray
*Attorney, Agent, or Firm*—Brinks Hofer Gilson & Lione

[57] ABSTRACT

The present invention includes apparatus for retaining a tapered flitch, having a generally semi-cylindrical veneer-producing zone, on a staylog for movement past a veneer-slicing knife, wherein the tapered flitch includes an axis of rotation. The apparatus comprisesstationary dogs coupled to the staylog for engaging the flitch and movable dogs for moving the flitch into engagement with the stationary dogs to hold the flitch on the staylog. The flitch is held on the staylog so that the axis of rotation of the veneer-producing zone is in a parallel relation with the veneer-slicing knife in order to minimize the amount of waste veneer taken from the veneer-producing zone.

42 Claims, 7 Drawing Sheets

METHOD AND APPARATUS FOR RETAINING A FLITCH FOR CUTTING

This application is a continuation of application Ser. No. 08/455,479 filed May 31, 1995 U.S. Pat. No. 5,562,137.

FIELD OF THE INVENTION

The present invention relates to veneer slicers having a staylog for moving a tapered flitch past a knife, and particularly to the means for retaining the flitch on the staylog so as to maintain the veneer-producing zone of the flitch in parallel relation to the knife.

BACKGROUND OF THE INVENTION

Staylogs for use with veneer slicers are known. Such staylogs hold a flitch and move relative to a slicing knife. As the flitch passes the knife, the knife slices a sheet of veneer from the flitch.

The veneer slicers use a plurality of dogs to hold the flitch in position against a mounting surface on the staylog. The dogs are clamping members that extend from the mounting surface of the staylog and are positioned on either side of the flitch along the length of the staylog. Typically, the dogs include a sharp-edged portion oriented parallel to the mounting surface of the staylog to cut into the flitch and hold it in place against the staylog. The dogs are moved toward each other to pinch the flitch therebetween.

An alternative dogging arrangement is disclosed in U.S. Pat. No. 5,150,746 to Weil. Weil discloses a plurality of oval-shaped rotating dogs that include a sharp-edged portion at the ends of the major axis of the oval. The dogs are arranged in parallel rows along the mounting surface of the staylog. A plurality of axially extending grooves are cut into the mounting surface of the flitch. The grooves are cut to align with the rows of dogs and are sized to allow the dogs to fit up into the grooves when the major axis of the oval is aligned with the groove. When the flitch is mounted on the staylog, the oval-shaped dogs extend upwardly into the grooves and are rotated to engage the sharp-edged portion of the dogs with the flitch.

Regardless of whether clamping dogs or rotating dogs are used, conventional flitch mounting techniques require that the flitch mounting surface be positioned adjacent the staylog mounting surface. Unfortunately, these conventional mounting techniques cause some of the best veneer on a log to be wasted.

A flitch is formed by cutting a log down the middle along its longitudinal axis so that the plane formed by the cut defines a flitch mounting surface and the periphery of the log defines a veneer-producing surface. Conventionally, the mounting surface of the flitch is positioned adjacent the mounting surface of the staylog and the veneer-producing outer portion of the log is positioned to be sliced into sheets of veneer by the knife.

In a rotary veneer slicer, however, because the tree trunk is naturally tapered, one end of the flitch is thicker than the other end, and consequently extends a greater distance from the mounting surface of the staylog. As a result, the veneer-producing zone of the flitch is frusto-conical, i.e., trapezoidal in cross-section when viewed from the side of the flitch or from the knife. As the staylog and the flitch are rotated in a rotary veneer slicer, the knife first encounters the thickest portion of the flitch. With each rotation, the knife slices a wider veneer sheet until the entire length of the flitch is exposed to the knife. Once the entire length of the flitch is being sliced, subsequent sheets are of substantially uniform width. However, the initial sheets, which are cut from the best part of the log, are too narrow to be useful, and are thrown away as wasted product. Consequently, some of the best veneer on a flitch is thrown away as waste. In addition, with the prior art methods of retention, the long slots formed along the length of the flitch removed sufficient material from the flitch that the flitch lost its rigidity and would flex in response to the pressure of the slicing knife resulting in, at best, nonuniform and unacceptable slices of veneer.

Therefore, a need exists for a method and apparatus for mounting a flitch on a staylog in such a manner that the flitch is securely retained on the staylog, that the production of desirable veneer from the outside of the flitch is increased and waste is reduced, and that waste is concentrated in the less desirable, inner portion of the flitch.

SUMMARY OF THE INVENTION

According to the present invention, a method and apparatus for retaining a flitch on a staylog comprises the use of stationary dog means coupled to the staylog and providing one or more surfaces for engaging the flitch, and pushing means for moving the flitch into engagement with the stationary dog means. The stationary dog means preferably includes a plurality of stationary pin dogs and the pushing means includes a plurality of pusher pins, the pin dogs and pusher pins extending orthogonally from the staylog. Each pin dog includes means for adjustably coupling the pin dog to the staylog and a plurality of annular knife edges for engaging the flitch. Each pusher pin includes means for adjustably coupling the pusher pin to the staylog.

The present invention further comprises means for retaining a tapered flitch on the staylog of a rotary veneer slicer with the outer surface and veneer producing zone of the flitch substantially parallel to the slicing knife. The flitch is formed to include a plurality of holes for receiving the pin dogs and pusher pins. The holes are deeper in the thick end of the tapered flitch and shallower in the thin end. However, all of the holes terminate at substantially the same distance from the outer surface of the flitch and cooperate to define a surface, or plane, upon which the flitch rests. The invention is not limited to use on rotary slicers, but can be incorporated into a reciprocating veneer slicer.

The staylog includes a longitudinal axis, an axially extending channel, and a pusher bar movably disposed in the channel for axial movement therein. The pushing means includes driving means for axially moving the pusher bar in the channel and at least one pusher pin coupled to the pusher bar for movement therewith. The pusher pin extends orthogonally from the pusher bar and includes means for adjusting the orthogonal extension of the pusher pin from the pusher bar.

The driving means includes at least one hydraulic piston coupled to the pusher bar for moving the flitch into engagement with the stationary dog means. The driving means can also include a second hydraulic piston coupled to the pusher bar for moving the flitch out of engagement with the stationary dog means.

The invention also includes a method for retaining a flitch on a staylog for slicing veneer from the flitch. The method comprises the steps of providing a flitch having a first plurality of holes for receiving a plurality of stationary pin dogs, positioning the plurality of stationary pin dogs in the first plurality of holes, and moving the flitch into engagement with the pin dogs to retain the flitch on the staylog.

The moving step includes the step of providing a plurality of pusher pins and the flitch includes a second plurality of holes for receiving the plurality of pusher pins. The moving step further includes the step of providing means for moving the pusher pins to move the flitch into engagement with the pin dogs.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

FIG. 10 illustrates the dogs of FIGS. 9*a*–9*b* installed on a conventional staylog: and.

DETAILED DESCRIPTION OF THE DRAWINGS

Figure 1:
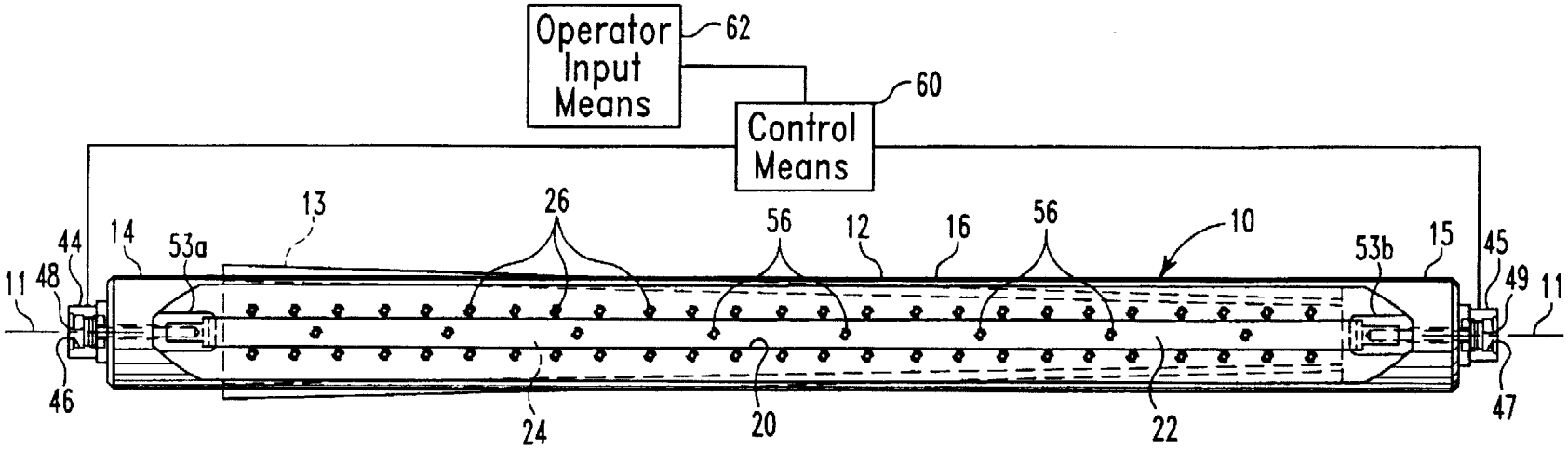
FIG. 1 is a top plan view of a staylog according to the present invention with a flitch (in dotted lines) mounted thereon.

The present invention includes apparatus for retaining a flitch 13 on a staylog 10. The apparatus includes stationary dog means coupled to the staylog 10 for engaging the flitch 13 and pushing means for moving the flitch 13 into engagement with the stationary dog means. The stationary dog means preferably includes stationary dogs 54 that further include a plurality of flitch engagement surfaces 80. The pushing means preferably includes a plurality of pusher pins 56 coupled to the staylog 10. The pusher pins 56 move the flitch 13 into engagement with the flitch engagement surfaces 80 which bite into the flitch 13 to retain the flitch 13 on the staylog.

The invention also includes a method of retaining a flitch 13 on a mounting surface 18 of a staylog 10. The method comprises the steps of providing the mounting surface 18 with a plurality of stationary flitch-engaging surfaces, providing the flitch 13 with a plurality of engagement surfaces adapted for engagement with the plurality of stationary flitch-engaging surfaces, placing the flitch 13 on the staylog 10 with its engagement surfaces adjacent the plurality of stationary flitch-engaging surfaces, and moving the flitch 13 relative to the staylog 10 for engagement of the flitch-engaging surfaces of the staylog 10 with the engagement surfaces of the flitch 13 and retention of the flitch 13 on the staylog 10.

Figure 2:
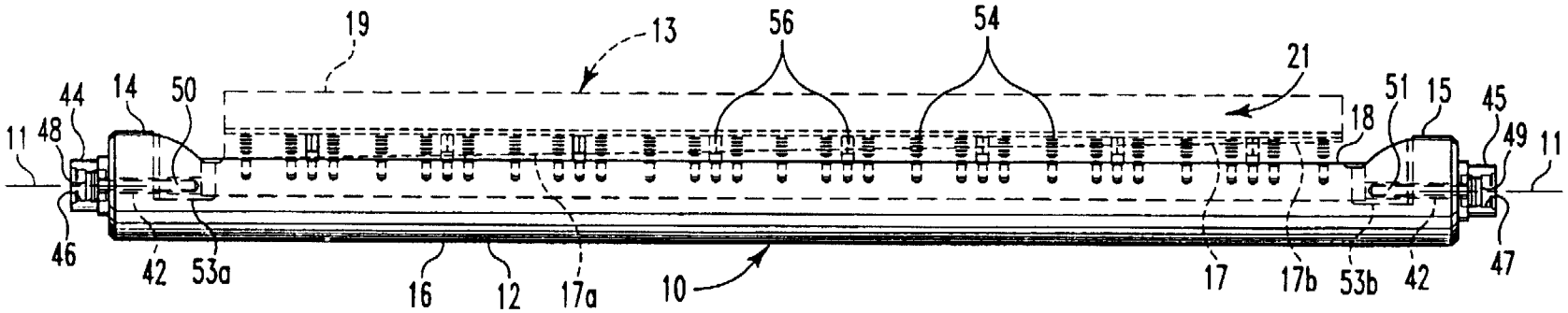
FIG. 2 is a side elevation of the staylog and flitch of FIG. 1.
Figure 5:
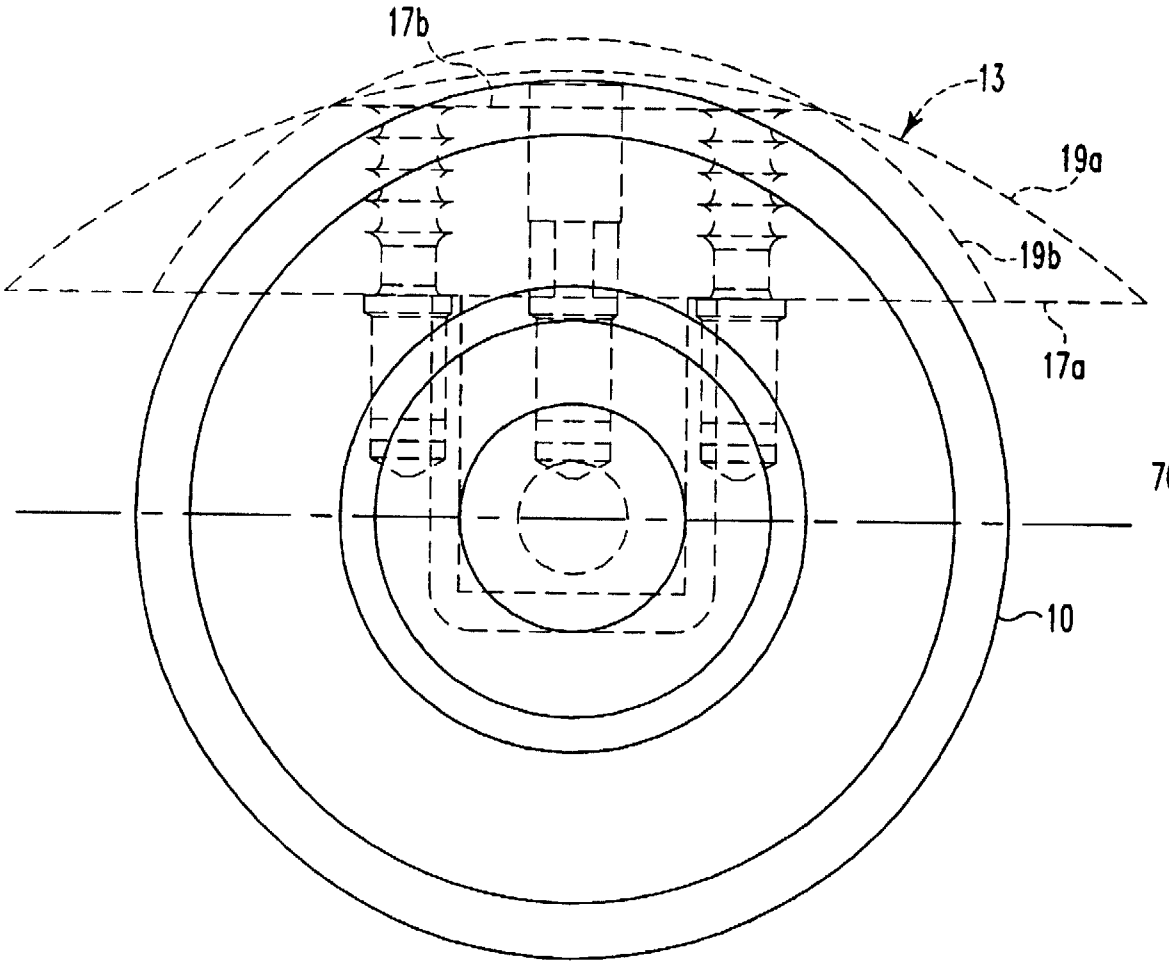
FIG. 5 is an enlarged end view of the staylog of FIG. 1.

A staylog 10 according to the present invention can include a cast cylinder 12 that defines end portions 14, 15 and a central portion 16 extending therebetween. As shown in FIGS. 1–2, a flitch 13 is mounted to the staylog 10 between the end portions 14, 15 and includes a mounting surface 17 and an outer veneer-producing surface 19. As shown in FIG. 5, the flitch mounting surface 17 extends from the wide end 17*a* at the thick end of the flitch 13 to the narrow end 17*b* at the thin end of the flitch 13.

The central portion 16 of the staylog 10 is milled to include a flat mounting surface 18 formed by a pair of mounting rails 16*a* and 16*b* defining an axial channel 20 therebetween extending along the longitudinal axis 11 of the cylinder 12. A pusher bar 22 is slidably disposed in the channel 20 and extends substantially along the length of the channel 20, the pusher bar 22 being several inches shorter than the channel 20 in order to allow for axial movement of the pusher bar 22 in the channel 20. The pusher bar 22 is sized to extend upwardly in the channel 20 so that the top surface 24 of the pusher bar 22 is substantially coplaner with, and forms part of, the mounting surface 18.

Figure 3:
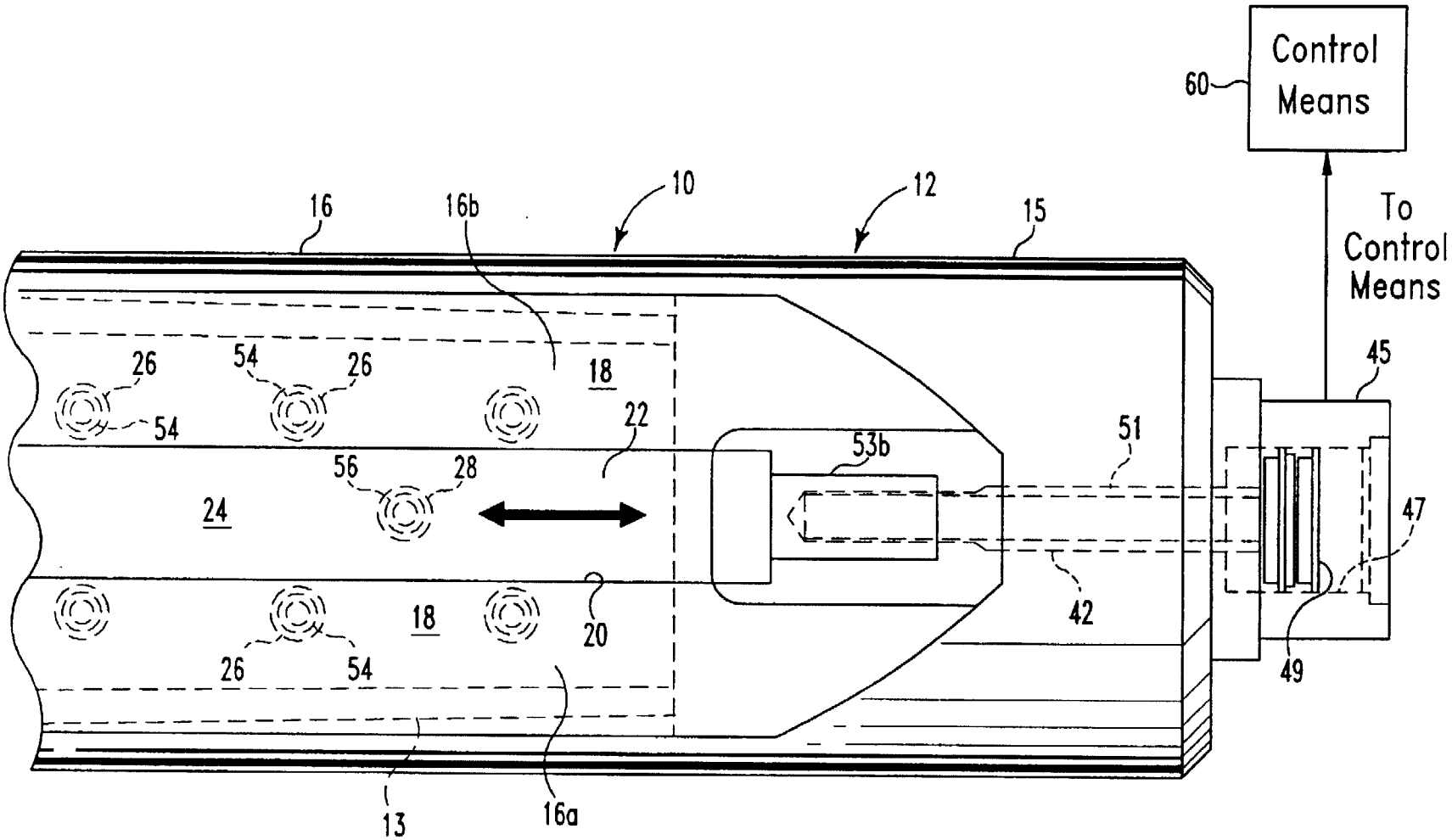
FIG. 3 is an enlarged top plan view of one end of the staylog and flitch of FIG. 1.
Figure 6:
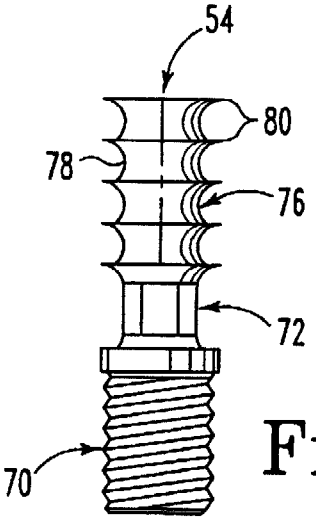
FIG. 6 is a side view of a stationary pin dog according to the present invention.

The mounting surface 18 includes a plurality of threaded pin dog apertures 26. The threaded apertures 26 are arranged in pairs along the length of the central portion 16, with the apertures of each pair disposed on opposite sides of the channel 20, as shown in FIGS. 1 and 3. A pin dog 54, shown more clearly in FIG. 6, is threaded into each pin dog aperture 26 to provide a plurality of stationary pin dogs extending orthogonally from the mounting surface 18.

Figure 7:
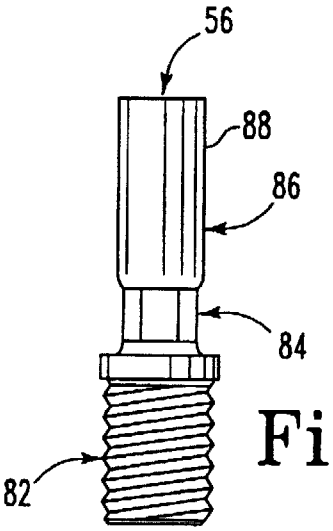
FIG. 7 is a side view of a pusher pin according to the present invention.

The top surface 24 of the pusher bar 22 includes a plurality of threaded pusher pin apertures 28 arranged in spaced-apart relation along the length of the pusher bar 22. A pusher pin 56, shown more clearly in FIG. 7, is threaded into each pusher pin aperture 28. A preferred arrangement of pin dogs 54 and pusher pins 56 is shown in FIGS. 1, 3 and 5 but other arrangements can be used without departing from the scope of the invention.

The end portions 14, 15 of the staylog 10 are essentially mirror images of each other, and include a central bore 42 that extends coaxially along the longitudinal axis 11 of the cylinder 12 and opens into the central channel 20. Piston housings 44, 45 are attached to the end portions 14, 15, respectively, and form cylinders 46, 47 which enclose drive pistons 48, 49, respectively. The pistons 48, 49 are positioned for movement along the axis 11. Pusher blocks 53*a*, 53*b* are disposed in the central bore 42 adjacent each end of the pusher bar 22. Piston rods 50, 51 are attached to the pistons 48, 49, respectively, and extend into the bore 42 to abut the pusher blocks 53*a*, 53*b*, respectively.

The pistons 48, 49 are controlled in a conventional manner by control means 60 which directs the flow of operating fluid from a reservoir (not shown) to one of the pistons 48, 49 and simultaneously permits a return flow of operating fluid from the other piston 49, 48 to the reservoir. Thus, application of operating fluid to piston 48 extends the piston rod 50 to drive the pusher block 53*a* and pusher bar 22 to the right. At the same time, operating fluid is vented from piston 49 back to the reservoir to prevent piston 49 from blocking movement of the pusher bar 22 to the right. Application of operating fluid to piston 49 extends the piston rod 51 to drive the pusher block 53b and pusher bar 22 to the left. At the same time, operating fluid is vented from piston 48 back to the reservoir to prevent piston 48 from blocking movement of the pusher bar 22 to the left. It will be appreciated that a single piston and piston rod can be attached directly to the pusher bar 22 to move the pusher bar 22 in both directions. In that case, the operating fluid would be directed to opposite sides of the piston.

The control means 60 includes control valves and actuating means connected as necessary to direct the operating fluid to the pistons 48, 49 and return the fluid to the reservoir. Operator input means 62 controls the flow of operating fluid by directing the control means 60 to direct operating fluid to piston 48 to drive the pusher bar 22 to the right or direct operating fluid to piston 49 to drive the pusher bar 22 to the left. Operator input means 62 can include actuating levers, push buttons or the like to indicate a desired direction of pusher bar movement.

As shown in FIG. 6, preferred pin dogs 54 include a lower threaded portion 70, a central polygon-shaped portion 72, and an upper flitch-engaging portion 76. The lower threaded portion 70 includes external threads for threadedly engaging the pin dog apertures 26. When used in conjunction with shims or washers, the lower threaded portion 70 also provides means for adjusting the orthogonal extension of the pin dogs relative to the mounting surface 18. The central polygon-shaped portion 72 is preferably hexagonal for engaging a wrench (not shown) for screwing the pin dog 54 into the pin dog aperture 26. The upper flitch-engaging portion 76 includes a scalloped side wall 78 defining a plurality of annular knife edges 80 for engaging a flitch 13. The annular knife edges 80 are axially spaced along the pin dogs 54 so as to be positioned at various distances from the staylog 10.

Preferred pusher pins 56 include a lower threaded portion 82, a central polygon-shaped portion 84, and an upper flitch-engaging portion 86. The lower threaded portion 82 and the central polygon-shaped portion 84 are substantially similar in design and identical in function to their counterparts 70, 72, respectively, on the pin dogs 54. The upper portion 86 includes a cylindrical side wall 88 for moving the flitch 13.

The description that follows relates to the invention as it may be incorporated into a rotary veneer slicer, although it will be clear to those skilled in the art that the invention can also be incorporated into veneer slicers that remove veneer from a flitch with non-rotary motion.

A flitch includes, generally, a conical portion corresponding to the base of the tree from which it was taken, and veneer taken from this portion of the flitch is frequently of the highest quality. As the flitch is normally mounted to the staylog, its outer surface and veneer-producing zone are not parallel to the slicing knife so that upon rotation of the staylog, only narrow waste sliced veneer is produced from the thicker end of the flitch. In the invention, the veneer-producing zone, which is generally a cylindrical segment, most generally a semi-cylindrical portion, is arranged with its axis of rotation parallel to the mounting surface and axis of rotation of the staylog.

Figure 4:
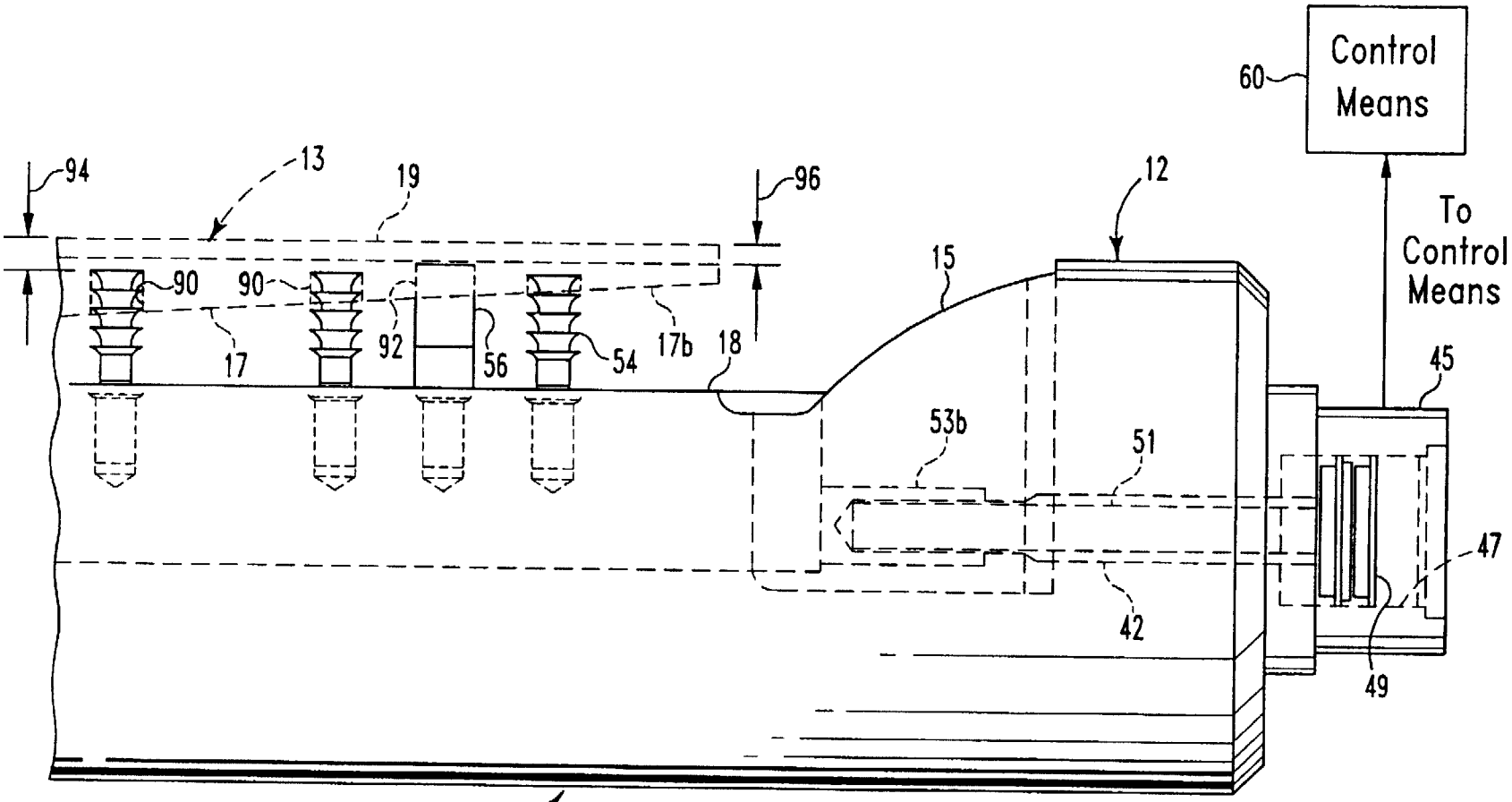
FIG. 4 is an enlarged side elevation of the end of the staylog and flitch of FIG. 1.

For example, the flitch 13 can be prepared for slicing by boring holes in the mounting surface 17 for receiving, and providing engagement surfaces for, the pin dogs 54 and the pusher pins 56. As shown in FIG. 4, a first plurality of pin dog-receiving holes 90 are sized to fit and positioned to engage the pin dogs 54, and a second plurality of pusher pin-receiving holes 92 are sized to fit and positioned to engage the pusher pins 56. The pin dog-receiving holes 90 are formed to extend a predetermined distance from the mounting surface 18 of the staylog 10 into the flitch 13 so that all of the holes 90 terminate at a first distance 94 from the veneer-producing surface 19, thereby forming a veneer-producing zone 21, best illustrated in FIG. 4. Likewise, the pusher pin-receiving holes 92 terminate at a second distance 96 from the veneer-producing surface 19, wherein the first distance 94 can be equal to the second distance 96. The primary factors in determining the first and second distances 94, 96 is maximizing the depth of the veneer-producing zone 21 while affording maximum surface contact between the pusher pins 56 and the pusher pin-receiving holes 92 as well as maximum engaging contact between the pin dogs 54 and the flitch 13.

The flitch 13 is positioned on the staylog 10 with the pin dogs 54 and pusher pins 56 disposed in their respective holes. When positioning the flitch 13 on the staylog 10, the flitch 13 is aligned so that the veneer-producing zone 21 is parallel to the mounting surface 18 of the staylog 10.

When a tapered flitch is to be sliced with a rotary veneer slicer, as shown in FIG. 4, due to the taper of the flitch 13, the mounting surface 17 of the flitch 13 will be positioned at an angle to the mounting surface 18 of the staylog 10. Consequently, the holes 90, 92 will have different depths in order to provide a constant-thickness veneer-producing zone 21.

Advantageously, the plurality of annular knife edges 80 on each pin dog 54 allows each pin dog 54 to engage the flitch 13 without regard to the distance between the flitch mounting surface 17 and the staylog mounting surface 18. Moreover, as shown in FIGS. 2 and 4, in those areas where the flitch 13 is thicker, and therefore more massive, more annular knife edges 80 engage the flitch 13 to provide additional holding capability where needed.

Once the flitch 13 is positioned on the staylog, the operator commands the pusher bar 22 to move in a first direction. The movement of the pusher bar 22 causes the pusher pins 56 to move the flitch 13 in the first direction until the flitch 13 engages the annular knife edges 80 on the pin dogs 54. The annular knife edges 80 cut into the flitch 13 and hold the flitch 13 in position.

When the operator is satisfied that the flitch 13 is securely retained on the staylog, the operator adjusts the staylog offset to produce the desired curvature of the veneer-producing surface 19. Staylog offset is the distance between the axis of rotation of the staylog/flitch combination and the longitudinal axis 11 of the staylog 10. As shown in FIG. 5, the curvature can vary between curvatures **19*a* and 19*b*, depending on the staylog offset selected by the operator. With maximum offset, the resulting curvature is indicated at 19*a*. With minimum offset, the resulting curvature is indicated at 19*b***.

If, because of the forces imposed on the flitch as it is sliced, the engagement between the flitch engaging surfaces at the pin dogs 54 and the engagement surfaces of the pin receiving holes 92 becomes too loose, the operator can command the pusher bar 22 to move in a second direction opposite to the first direction. The movement of the pusher bar 22 causes the pusher pins 56 to move the flitch 13 in the second direction until the pin dogs 54 engage the flitch at different engagement surfaces of the pin-receiving holes 92 for completion of the slicing operation. When the slicing operation has been completed, the pusher bar 22 can be positioned so flitch 13 disengages from the annular knife edges 80. Once the flitch 13 is disengaged from the pin dogs 54, it can be removed and replaced with another flitch It is understood that the knife edges can be modified to include non-annular knife edges without departing from the scope of the invention. For example, diametrally opposed knife edges could be aligned with the axial movement of the flitch 13 so as to engage the flitch 13 regardless of whether the flitch 13 moves to the right or left. However, annular knife edges are preferred because they provide more flitch-engaging surface area.

Preferred pusher pins 56 do not include knife edges in order to avoid pusher pin engagement with the flitch 13 while disengaging the flitch 13 from the pin dogs 56. If the pusher pins 56 included knife edges, the flitch 13 could remain engaged with the pusher pins, thereby preventing the easy removal of the flitch 13 from the staylog 10.

It will be appreciated that the pin dogs 54 could also be mounted on a conventional staylog and the flitch retained by pushing a movable pin dog toward a stationary pin dog and pinching the flitch 13 therebetween in a conventional fashion. Modifying a conventional staylog to include stationary and movable pin dogs 54 would eliminate the need for pusher pins 56 and pusher pin-receiving holes 92, thereby simplifying flitch preparation while still allowing for multiple knife edges 80 to engage the flitch 13 at various distances from the staylog mounting surface The preceding description related to dogs 54, 56 used with a non-conventional staylog 10. However, it would be clear to one of ordinary skill in the art that a conventional staylog could be modified to incorporate the present invention without departing from the scope of the invention. For example, FIGS. 8–11 illustrate alternative embodiments of the invention that can be incorporated into a conventional staylog.

Figure 8A:
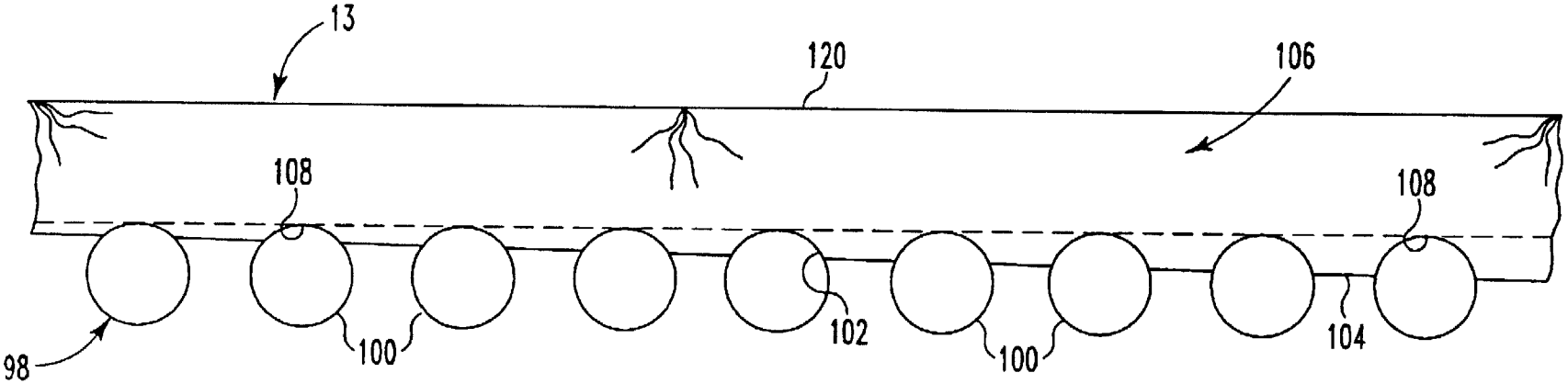
FIGS. 8*a*–8*b* show illustrative positions and depths of plunge cuts made by a dado saw.
Figure 8B:
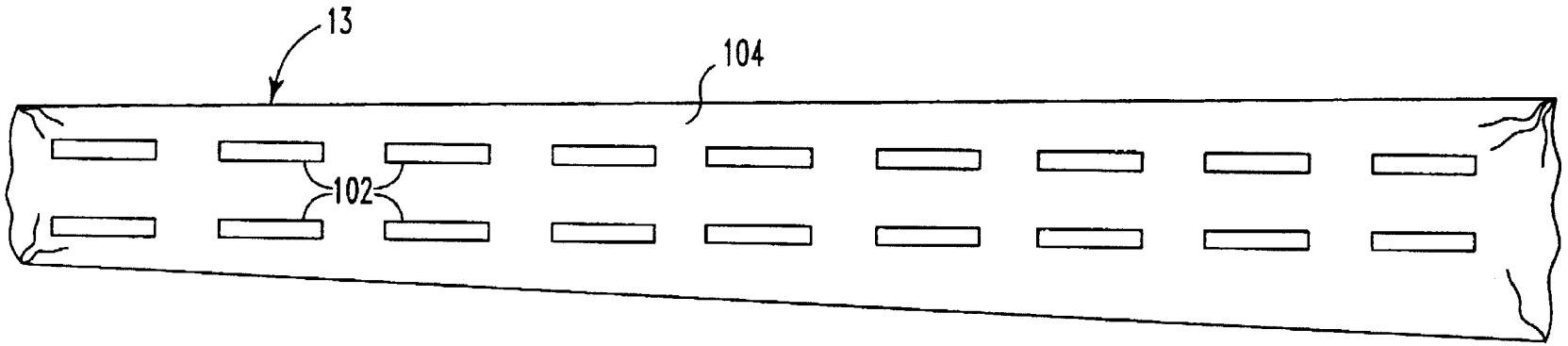

As generally indicated in FIGS. 8*a*–8*b*, hole forming means 98, illustratively a dado saw blade 100, can be used to cut dado holes 102 into the flitch mounting surface 104. The dado holes 102 have a generally rectangular opening 106 at the flitch mounting surface 104 (FIG. 8*b*) and a generally circular depth profile 108 (FIG. 8*a*). Dado holes 102 can be formed efficiently by moving a dado saw blade 100 along the flitch mounting surface 104 and plunging the saw blade 100 into the flitch at the desired positions to a desired depth, which would be determined by the thickness of the veneer-producing zone 21. Of course by using dado holes 102 can be formed by using other hole forming means, such as a router, drill, lasers, or the like. It is also possible to vary the shape of the dado holes 102 without departing from the scope of the invention. For example, the hole forming means 98 can be used to bore generally rectangular holes having a flat, rather than circular, depth profile.

Figure 9B:
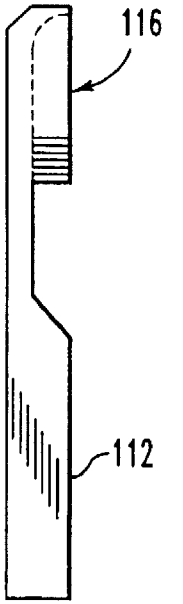
FIGS. 9*a*–9*b* show a dog configured to match a plunge cut of FIGS. 8*a*–8*b*.
Figure 9A:
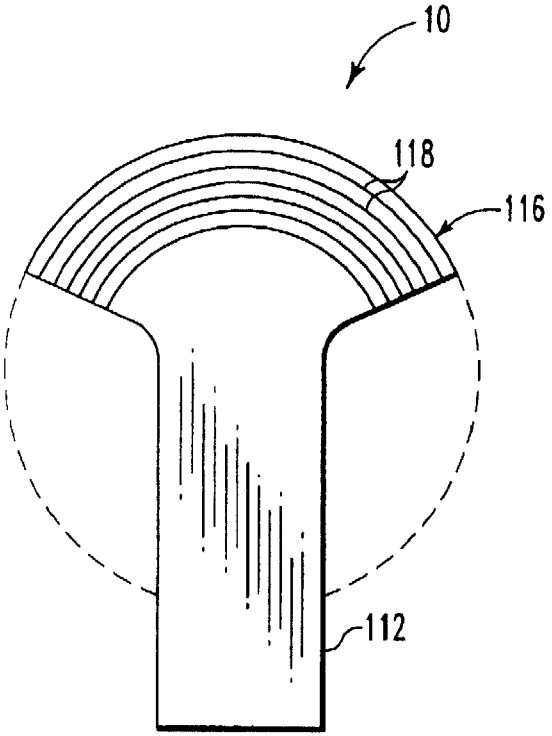
Figure 11B:
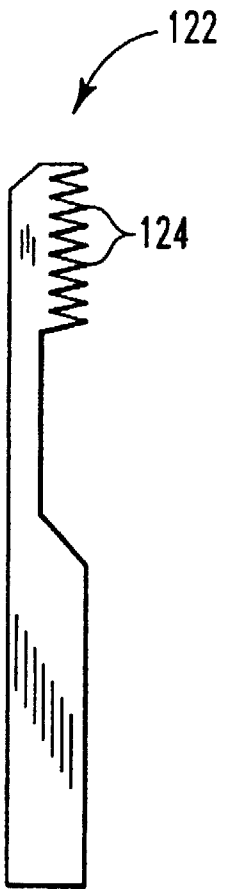
FIGS. 11*a*–11*b* show an alternative embodiment of the dog of FIGS. 9*a*–9*b*.
Figure 11A:
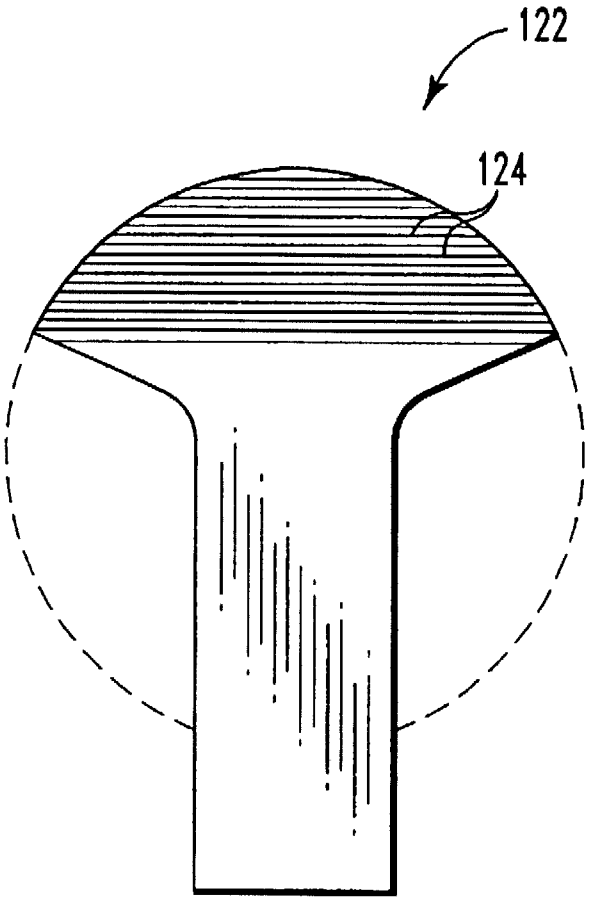

A flitch-retaining dog 110 for use with the dado holes 102 is illustrated in FIGS. 9*a*–9*b*. The dogs include an elongated actuating arm 112 and a flitch-engaging portion 116 extending from the actuating arm 112. The flitch-engaging portion 116 is configured to conform to the depth profile 10S of the dado holes 102 and includes a plurality of circular flitch-engaging knife edges 118 configured to run parallel to the depth profile 108 of the dado hole 102. In an alternative embodiment, dogs 122 include straight knife edges 124, as shown in FIGS. 11*a*–11*b*, configured to run parallel to the veneer-producing surface 120 of the flitch. Of course, if the selected dado holes 102 include a flat depth profile, the dogs can include a rectangular flitch-engaging portion to conform to the flat depth profile.

Figure 10:
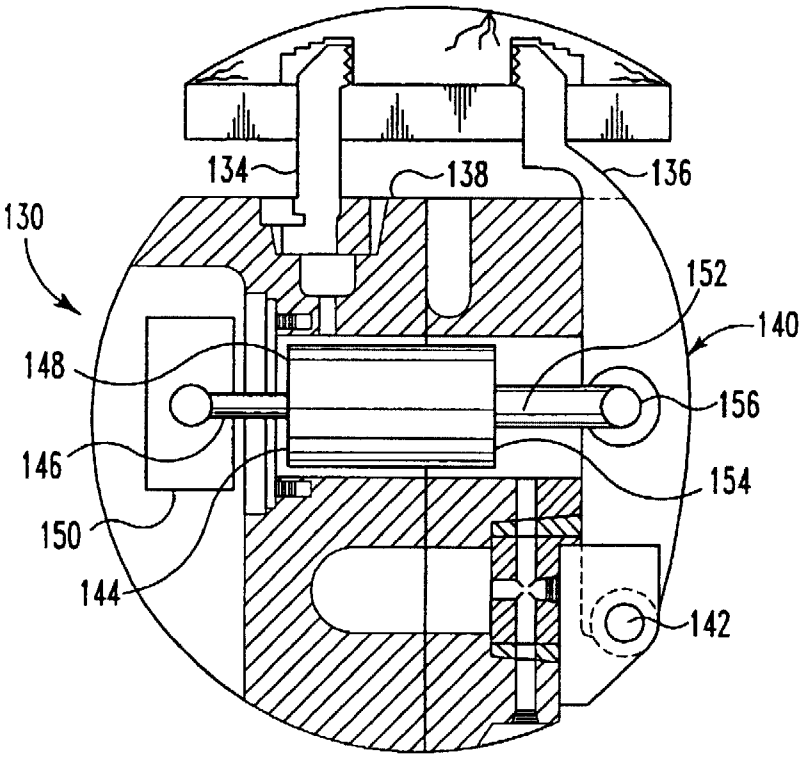

Dogs 110, 122 can be coupled to a conventional staylog 130, as illustratively shown in FIG. 10. The dogs 110, 122 are mounted to the staylog 130 to form stationary dogs 134 and movable dogs 136 which are movable toward and away from the stationary dogs 150 to move the flitch 13 into engagement with the stationary dogs 134. The stationary dogs 134 extend from the staylog mounting surface 138 and the movable dogs 136 are formed on one end of a pivotable lever arm 140. The lever arm 140 pivots about pivot pin 142 in response to actuation of a conventional hydraulic (or pneumatic) piston-cylinder 144.

The piston-cylinder 144 can be a self-contained unit installed in the staylog 130, as illustrated in FIG. 10. The piston-cylinder 144 includes a connecting rod 146 coupled to a trunion block 150 fitted into the staylog 130 and a first end 148 of the cylinder 144. A piston rod 152 extends from a second end 154 of the cylinder 144 to a connecting pin 156 formed in the lever arm 140.

The narrowest portion of the flitch 13 would be positioned farthest from the staylog mounting surface 104, due to the taper of the log, as previously described with reference to the embodiments of FIGS. 1–7.

An important feature of the present invention is the use of individual holes bored into the flitch mounting surface to accept flitch-retaining dogs, with the holes being separated from each other by areas of solid wood. It is the areas of solid wood between the holes that strengthen the edges of the flitch to eliminate flexing of the flitch edge under pressure from the knife. Eliminating flexing at the flitch edge allows a slicer to remove more of the best veneer from the edges without the problem of nonuniform and unacceptable veneer that arises in conventional flitch-retaining methods and apparatus.

In another alternative embodiment of the invention, conventional stationary and movable dogs operate in a conventional fashion to retain the flitch on the staylog. However, the ends of the staylog are differentially offset from the axis of rotation of the staylog so as to maintain the veneer-producing zone parallel to the knife. In being differentially offset, one end of the staylog is offset from the axis of rotation by a greater distance than the other. That permits the thicker end of a tapered flitch to be retained at the same distance from the knife as the thinner end.

In yet another alternative embodiment of the invention, conventional stationary and movable dogs operate in a conventional fashion to retain the flitch on the staylog. However, rather than differentially offsetting the staylog relative to the axis of rotation of the staylog, the staylog mounting surface can be pivoted about one end or about its center in order to orient the mounting surface at an angle relative to the staylog. Rotating the mounting surface relative to the staylog allows the staylog to accommodate the taper of the flitch and retain the veneer-producing zone generally parallel to the knife, while using holes having equal, and minimum, depth for receiving the dogs.

Although the invention has been described in detail with reference to a certain preferred embodiment, variations and modifications exist within the scope and spirit of the invention as described and defined in the following claims. For example, although the invention has been described in a rotary veneer slicer where it can be particularly advantageous in reducing waste, it can also be advantageously used in a transversely moving veneer slicer.

I claim:

1. An apparatus for retaining a flitch, said flitch including a veneer-producing surface and a mounting surface having a plurality of cavities at predetermined positions in the fitch mounting surface, the apparatus comprising:

a staylog, and a plurality of dogs coupled to the staylog for retaining the flitch on the staylog, the dogs being located at positions corresponding to the plurality of cavities in the flitch mounting surface and being formed to include a flitch-engaging portion configured to engage at least a portion of the corresponding cavities and to position veneer-producing surface for cutting.

2. The apparatus of claim 1 wherein the plurality of dogs include stationary and tall dogs, and each dog includes a plurality of knife edges.

3. The apparatus of claim 2 wherein the cavities include curved surfaces and the plurality of knife edges are curved to engage the curved surfaces.

4. The apparatus of claim 2 wherein the plurality of knife edges are straight and oriented parallel to the veneer-producing surface of the flitch.

5. A method of retaining a flitch on a staylog for slicing veneer from a tapered veneer-producing zone, the staylog having a plurality of dogs, the method comprising the steps of:

providing a flitch having a plurality of holes for receiving the plurality of dogs, the holes having a depth profile and the dogs having a flitch engaging portion configured to generally conform to the depth profile, the flitch-engaging portion including a plurality of flitch-engaging surfaces, positioning the plurality of dogs in the plurality of holes, and engaging the flitch with at least one of the plurality of flitch-engaging surfaces on each of the plurality of dogs to retain the flitch on the staylog with the tapered veneer-producing zone maintained in parallel relation to a veneer-slicing knife.

6. An apparatus for retaining a tapered flitch on a staylog for movement past a veneer-slicing knife, said flitch providing a slightly frusto-conical veneer-producing surface, the apparatus comprising:

a plurality of stationary dogs extending from the staylog, each stationary dog having at least one flitch-engaging surface; and means for engaging the flitch-engaging surfaces of the stationary dogs with the flitch;

said plurality of stationary dogs extending from the staylog for a distance sufficient to hold the slightly frusto-conical veneer-producing surface of the flitch substantially parallel with the veneer knife, thereby permitting the veneer slicing knife to cut veneer from substantially the entire length of the slightly frusto-conical veneer-producing surface.

7. The apparatus of claim 6 wherein the stationary dogs are adjustably coupled to the staylog.

8. The apparatus of claim 6 wherein the stationary dogs extend different distances from the staylog.

9. The apparatus of claim 6 wherein the flitch includes a plurality of cavities located for providing walls for engagement with the flitch-engaging surfaces of the plurality of dogs.

10. The apparatus of claim 9 wherein said plurality of dogs comprises a plurality of pin dogs extending orthogonally from the staylog, each pin dog having at least one annular edge, and wherein said plurality of cavities comprises a plurality of round holes into which the plurality of pin dogs extend.

11. The apparatus of claim 10 wherein each of the plurality of pin dogs has a plurality of annular edges.

12. The apparatus of claim 6 further comprising means for supporting the staylog for rotation and movement with respect to the veneer-slicing knife.

13. The apparatus of claim 6 wherein said means for engaging the flitch-engaging surfaces of the stationary dogs with the flitch comprises means for moving the flitch substantially in a direction transverse to the direction of its movement with respect to the veneer-slicing knife.

14. The apparatus of claim 13 wherein said moving means comprises a fluid powered piston and at least one pusher rod.

15. In an apparatus for slicing veneer with a knife from a flitch carried by a rotating staylog, the improvement comprising means for retaining a tapered flitch with its outer surface substantially parallel to the knife.

16. The apparatus of claim 15 wherein said means for retaining a tapered flitch with its outer surface substantially parallel to the knife comprises a plurality of dogs extending from the staylog, and a plurality of holes in the flitch located to provide flitch surfaces for engagement by the plurality of dogs.

17. The apparatus of claim 16 wherein the dogs extend from the staylog a distance sufficient to hold the tapered flitch with its outer surface substantially parallel to the knife.

18. The apparatus of claim 16 wherein the holes in the flitch have different depths.

19. The apparatus of claim 18 wherein the holes are deeper at the thicker end of the tapered flitch and shallower at the thinner end of the tapered flitch.

20. The apparatus of claims 19 wherein the holes terminate at substantially the same distance from the outer surface of the flitch.

21. The apparatus of claim 16 wherein a plurality of said dogs is stationary and said staylog comprises means for moving said flitch relative to said plurality of stationary dogs to engage flitch surfaces of said holes with said stationary dogs.

22. The apparatus of claim 21 wherein each of said plurality of stationary dogs have an edge for engaging flitch surfaces of said holes.

23. The apparatus of claim 22 wherein each of said plurality of stationary dogs have a plurality of annular edges for engaging flitch surface of said holes.

24. The apparatus of claim 16 wherein said plurality of dogs include dogs carried by said staylog for adjustable extension from said staylog.

25. The apparatus of claim 16 wherein said plurality of dogs extend different distances from said staylog.

26. The apparatus of claim 21 wherein said moving means comprises at least one pusher bar for said flitch and a fluid cylinder for moving said pusher bar and flitch relative to said stationary pin dogs.

27. The apparatus of claim 21 wherein said moving means comprises a plurality of movable pusher pins extending into a portion of said plurality of holes, and means for moving said movable pusher pins relative to said stationary pins.

28. The apparatus of claim 21 wherein said moving means moves said flitch with respect to said stationary dogs in a direction substantially parallel to said knife.

29. The apparatus of claim 21 wherein said moving means comprises, pusher means for engaging the flitch, a hydraulic cylinder and piston driving said pusher means, and a control for moving said piston, said pusher means and said flitch in plural directions for engaging and holding said flitch surfaces of said holes and said stationary dogs and for disengaging said flitch surfaces and said stationary dogs.

30. An apparatus for retaining a flitch having a longitudinal axis on a staylog for movement past a veneer-slicing knife, the apparatus comprising:

stationary dog means coupled to the staylog for engaging the flitch, and means for moving the flitch parallel to the longitudinal axis into engagement with the stationary dog means to hold the flitch on the staylog.

31. An apparatus for retaining a flitch on a staylog, the flitch including a plurality of dado cuts formed in a flitch mounting surface, the apparatus comprising:

a staylog for carrying the flitch, a first plurality of fan dogs attached to the staylog and positioned to be received by a first group of the plurality of dado cuts for engaging the flitch, and a second plurality of fan dogs attached to the staylog and positioned to be received by a second group of the plurality of dado cuts for moving the flitch into engagement with the first plurality of fan dogs to retain the flitch on the staylog.

32. The apparatus of claim 31 wherein the second plurality of fan dogs moves generally orthogonally to a longitudinal axis of the flitch to pinch the flitch between the first and second pluralities of fan dogs.

33. A method for retaining and cutting veneer from a flitch with a tapered outer surface with a knife, comprising providing a staylog with a plurality of flitch-engaging surfaces extending from said staylog a distance sufficient to hold the flitch with its tapered outer surface substantially parallel to the knife;

providing the flitch with a plurality of surfaces located for engagement with the plurality of flitch-engaging surfaces;

engaging the plurality of flitch-engaging surfaces of the staylog with the plurality of flitch surfaces with the tapered outer surface of the tapered flitch substantially parallel to the knife;

moving the flitch and the knife relative to one another and cutting veneer from substantially the entire length of the tapered outer surface of the flitch.

34. The method of claim 33 wherein the plurality of flitch-engaging surfaces are formed by a plurality of stationary dogs.

35. The method of claim 33 wherein the plurality of surfaces located for engagement with the plurality of flitch-engaging surfaces are formed the surfaces of a plurality of holes formed in the flitch.

36. The method of claim 35 wherein the plurality of surfaces are formed at different depths in the flitch.

37. The method of claim 36 wherein the plurality of surfaces are formed at a substantially constant distance from the tapered outer surface of the flitch.

38. The method of claim 33 wherein at least a portion of the plurality of flitch-engaging surfaces of the staylog are stationary and are engaged with a plurality of said flitch surfaces by moving the flitch with respect to the stationary flitch-engaging surfaces.

39. The method of claim 38 wherein the flitch is moved substantially axially along the axis of rotation.

40. The method of claim 37 wherein at least a portion of the flitch-engaging surfaces of the staylog are movable and move the flitch surfaces into engagement with the flitch-engaging surfaces of the staylog.

41. The method of claim 33 wherein the flitch and knife are moved relative to one another by rotating the staylog and moving it in the direction of the knife.

42. A method of slicing veneer with a knife from a rotating tapered flitch, comprising providing at least two flitch-engaging surfaces axially spaced on a staylog, said two flitch-engaging surfaces having a sufficient height so that a tapered flitch can be supported to provide an axis of rotation of a veneer producing zone parallel to the knife, placing a tapered flitch on the at least two flitch-engaging surfaces with the axis of rotation of the veneer producing zone parallel to the knife, and rotating the flitch with the at least two flitch-engaging surfaces and moving the knife and rotating flitch relative to each other to remove veneer from the veneer-producing zone of the flitch.

* * * * *

UNITED STATES PATENT AND TRADEMARK OFFICE

CERTIFICATE OF CORRECTION

PATENT NO. : 5,701,938
DATED : December 30, 1997
INVENTOR(S) : Robert D. Brand

It is certified that error appears in the above-identified patent and that said Letters Patent is hereby corrected as shown below:

Column 8,
Line 63, between "position" and "veneer-producing" please insert the word -- the --.

Signed and Sealed this

Twenty-ninth Day of January, 2002

*Attest:*

*Attesting Officer*

JAMES E. ROGAN
*Director of the United States Patent and Trademark Office*